US008960441B1

(12) United States Patent
Marquis et al.

(10) Patent No.: US 8,960,441 B1
(45) Date of Patent: Feb. 24, 2015

(54) ROOM TEMPERATURE BUTTER DISH

(71) Applicant: Clever Concepts LLC, Danbury, CT (US)

(72) Inventors: Linda A. Marquis, Danbury, CT (US); James Alphonse Marquis, Danbury, CT (US); Jeffrey William Londona, Ridgefield, CT (US); Mark Henry Mendez, Wappingers Falls, NY (US)

(73) Assignee: Clever Conceptz LLC, Danbury, CT (US)

( * ) Notice: Subject to any disclaimer, the term of this patent is extended or adjusted under 35 U.S.C. 154(b) by 0 days.

(21) Appl. No.: 14/106,980

(22) Filed: Dec. 16, 2013

(51) Int. Cl.
*B65D 1/34* (2006.01)
*B65D 6/04* (2006.01)
*A47G 19/26* (2006.01)

(52) U.S. Cl.
CPC ..... *A47G 19/26* (2013.01)
USPC ..... 206/553; 206/525; 220/695; 220/799; D7/502

(58) Field of Classification Search
USPC ..... 206/229, 564, 565, 553; 220/574, 220/574.1, 921; D7/502; 211/70.7; 248/37.3; 99/348
See application file for complete search history.

(56) References Cited

U.S. PATENT DOCUMENTS

| | | | | | |
|---|---|---|---|---|---|
| 12,876 | A | | 5/1855 | Stimpson | |
| D158,999 | S | * | 6/1950 | Paul | D7/502 |
| 2,595,696 | A | * | 5/1952 | Paul | 83/427 |
| D179,021 | S | * | 10/1956 | McDonnell | D7/502 |
| 3,130,288 | A | | 4/1964 | Monaco et al. | |
| 3,268,111 | A | | 8/1966 | Duddy | |
| 3,563,404 | A | * | 2/1971 | Barchus | 220/799 |
| D261,214 | S | | 10/1981 | Oelzner | |
| 5,611,206 | A | | 3/1997 | Sargent | |
| 5,858,089 | A | | 1/1999 | Martinovic | |
| 6,244,065 | B1 | | 6/2001 | Wuestman | |
| D540,118 | S | | 4/2007 | Vlahos | |
| 7,290,677 | B2 | | 11/2007 | Wuestman | |
| 2004/0011216 | A1 | | 1/2004 | Jodrey | |
| 2009/0120941 | A1 | * | 5/2009 | Garaysa | 220/574.1 |
| 2012/0111873 | A1 | | 5/2012 | Gabriel | |

FOREIGN PATENT DOCUMENTS

| | | |
|---|---|---|
| EP | 0211994 A1 | 8/1985 |
| GB | 1273628 | 5/1972 |

OTHER PUBLICATIONS

Alfille Innovations Ltd., Owner's Manual Butter Wizard Temperature Controlled Butterdish, www.butterwizard.com.
Ineos ABS, Lustran ABS 248FC, ABS Medical & Food Contact Grade, www.ineos-abs.com.
Adobe Living, Yo Yo butter dish, orange, Oct. 28, 2013, http://mydeco.com/p/yo-yo-butter-dish-orange/ GB000000728FC35592 . . . 1 of.

* cited by examiner

*Primary Examiner* — Mickey Yu
*Assistant Examiner* — Chun Cheung
(74) *Attorney, Agent, or Firm* — Mark Nowotarski

(57) ABSTRACT

A room temperature butter dish has a cover and a base. The base has two end walls and two side walls that a stick of butter resides between. The cover sits over the end walls and side wall and rests on the base. The end walls have raised shoulders and a horizontal knife scraper between the shoulders. The knife scraper is above the height of a conventional stick of butter. Butter can be scrapped off of a knife and rest on top of a stick of butter below. The shoulders of the end walls keep the bottom edge of the cover from hitting any butter as the cover is put on or removed.

12 Claims, 12 Drawing Sheets

ROOM TEMPERATURE BUTTER DISH

BACKGROUND

Butter is enjoyable when served at room temperature. It is soft, flavorful and melts easily on warm foods. Unfortunately, it can also be messy. There is need, therefore, for a butter dish that will hold and serve butter at room temperature without creating a mess.

SUMMARY OF INVENTION

The summary of the invention is provided as a guide to understanding the invention. It does not necessarily describe all alternative embodiments of the invention or the most generic embodiment of the invention.

A room temperature butter dish holds butter or other food spread at room temperature in a clean, sanitary and convenient manner. Referring to FIG. 1, the dish 100 comprises a cover 110 and a base 120. The base comprises walls 130, a bottom 140 and an optional knife holder 150. The walls comprise end walls 132 and side walls 134. The end walls comprise a knife scraper 133, raised shoulders 131 and supports 135. The bottom comprises tabs 142. The knife holder comprises a first U-channel 152 and a second U-channel 154.

The end walls are vertically mounted on opposite ends of the base and face each other. The end walls, therefore, define a butter container volume 137 into which a portion of butter, such as a stick of butter, is placed. The container volume is the volume between the end walls. The upper edges of said container volume are indicated by dashed lines 139. The bottom surface of the container volume is the bottom of the base. Said container volume may be greater than the volume of 0.25 lb of butter. Said container volume may be about that of 1 lb of butter. In normal operation, a user removes the cover, picks up a knife held in the knife holder and cuts a piece of butter for use. If there is excess butter on the knife, the butter can be removed by dragging the knife across the scraper. The height of the scraper 162 is about the same height as a stick of butter 163. A suitable height of the scraper is about 1.3 inches for Elgin, or eastern US style butter. A suitable height of the scraper for western butter is about 1.5 inches. Thus both the original stick of butter and the excess butter on the knife stay within the container volume. The height of the shoulder 164 is greater than the height of the scraper so that when a user places the cover on the base, the lower edges of the cover 117 are kept out of the container volume. Thus the edges of the cover are kept away from the butter within the container volume and remain clean. A suitable height for the shoulders is about 1.5 inches. The knife U-channels are high enough so that even if there is some butter remaining on the blade of the knife, said butter will not touch a counter or table the base is sitting on. When the cover rests on the base, it fully contacts the base so that there are no gaps large enough for an insect, such as an ant or fly, to get through. The butter, therefore remains insect free and is more sanitary than if it were left out in the open. The side walls have sufficient height 168 such that they will protect the cover from entering the container volume, but low enough so that all of the butter within the container volume can be conveniently scraped out with a conventional butter knife. A suitable height is about 0.35 inches. The side walls may further comprise graduations 174. Each graduation may correspond to standard unit of butter, such as an ounce or a tablespoon. The graduations may be on the top of the side walls, the inside side of the side walls, the outside side of the side walls or combinations thereof. Graduations may also or alternatively be provided on the bottom.

The height of the bottom 141 is sufficient for a person to hold the tabs with his/her fingers to pick up the butter dish. A suitable height of the bottom is about 0.62 inches. The width of the base 143 in combination with the height of the cover 115 is small enough so that a person could reach his/her hand around the cover to pick up the dish by the base. A suitable base width is about 3.58 inches. A suitable cover height is about 1.9 inches. The width of the bottom of the cover 113 may be somewhat larger than the width of the top of the cover 111 so that the cover will be easy to place over the top of the end walls with adequate clearance with the top of the container volume. A suitable width of the bottom cover is about 2.08 inches. A suitable width of the top of the cover is about 2.01 inches. The wedge shape would then guide the cover to a fixed position on the base as the cover lines up with the end walls of the base. The end walls of the base are similarly tapered. The supports on the end walls are tapered to making it easy to orient the cover over the end walls and guide the cover to a fixed position as it is lowered. A suitable bottom width of the supports is about 0.11 inches. A suitable top width of the supports is about 0.07 inches. The clearance between the end walls and the cover bottom when the cover is placed over the end walls also serves to reduce the chance that the cover will come in contact with butter within the container volume. A suitable clearance is about 0.13 inches.

The side walls 112 and top wall 114 of the cover may be flat and may comprise one or more trademarks 116 or other ornamentation. The exterior corners 118 and interior corners 172 of the butter dish may be rounded so that the dish can be easily cleaned. The radius of curvature of the interior corners may be large enough so that a conventional butter knife may be used to scrape out any butter residing therein. The width of the scrapper 166 should be wide enough to accommodate a conventional butter knife. A suitable width is about 0.89 inches.

DETAILED DESCRIPTION

The detailed description describes non-limiting exemplary embodiments. Any features of one embodiment may be combined with other features disclosed herein as required by different applications for at least the benefits described herein. As used herein, the term "about" means plus or minus 10% of a given value unless specifically indicated otherwise.

Figure 1:
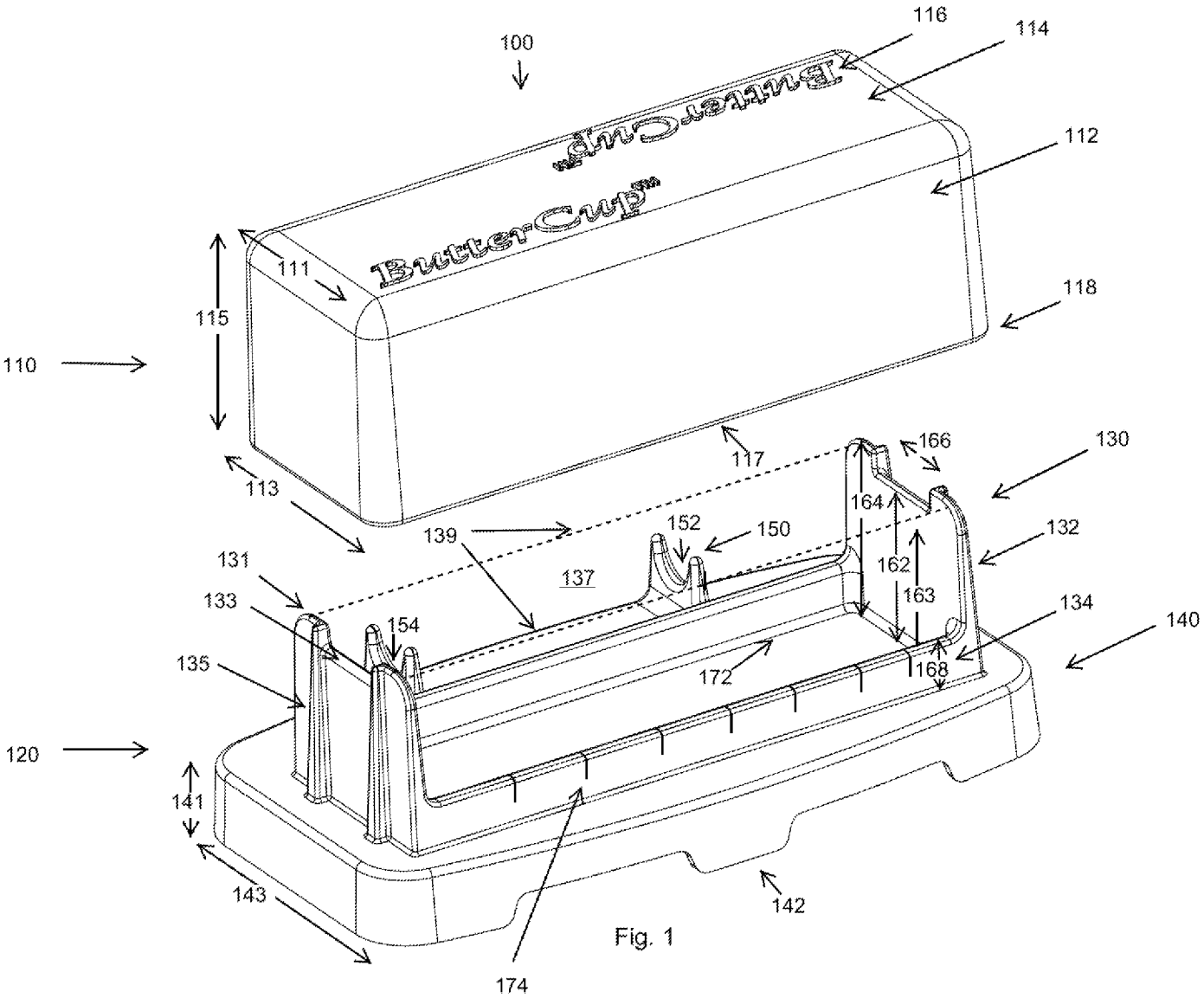
FIG. 1 is a perspective exploded view of a room temperature butter dish.
Figure 2B:
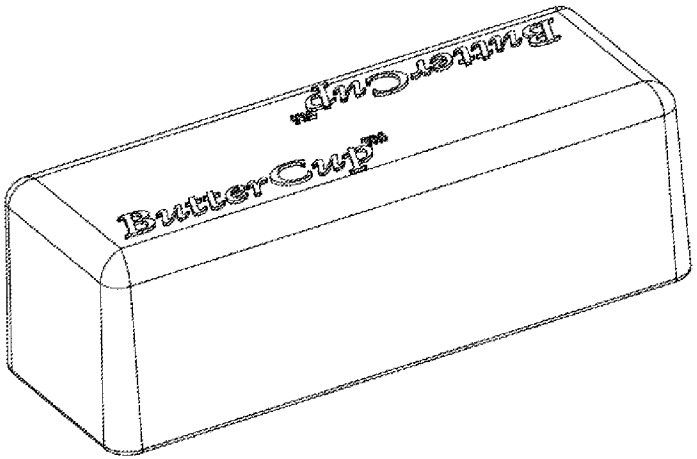
FIG. 2B is a perspective view of the same cover.
Figure 2D:
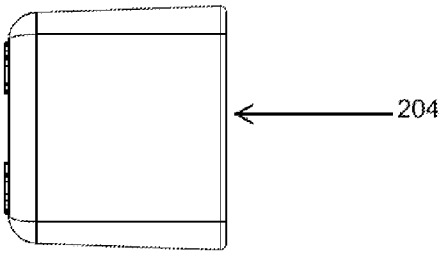
FIG. 2D is a rotated end view of the same cover.
Figure 2A:
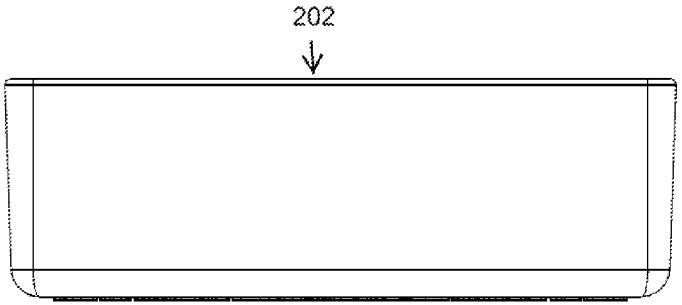
FIG. 2A is an inverted side view of the cover of the butter dish of FIG. 1.
Figure 2C:
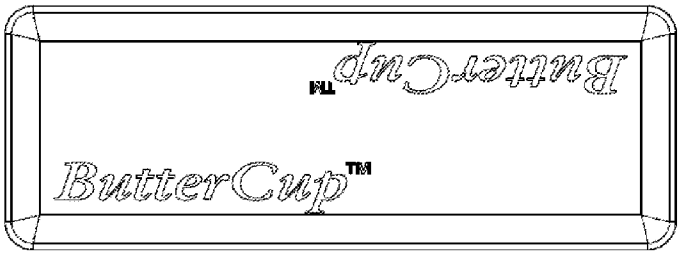
FIG. 2C is a plan view of the same cover.

FIG. 2A shows an inverted side view of the cover of FIG. 1. The bottom edge 202 is shown at the top. FIG. 2B shows a perspective view of the same cover. FIG. 2C shows a plan view of the same cover. FIG. 2D shows an end view of the same cover rotated 90 degrees. The bottom edge 204 is shown on the side.

The cover may be made of any suitable food-safe material, such as plastic, metal, rubber, wood, glass or combinations thereof. Suitable plastics include those that are compatible with dishwashers and for extended contact with oils. A suitable plastic is acrylonitrile butadiene styrene (ABS).

Figure 3B:
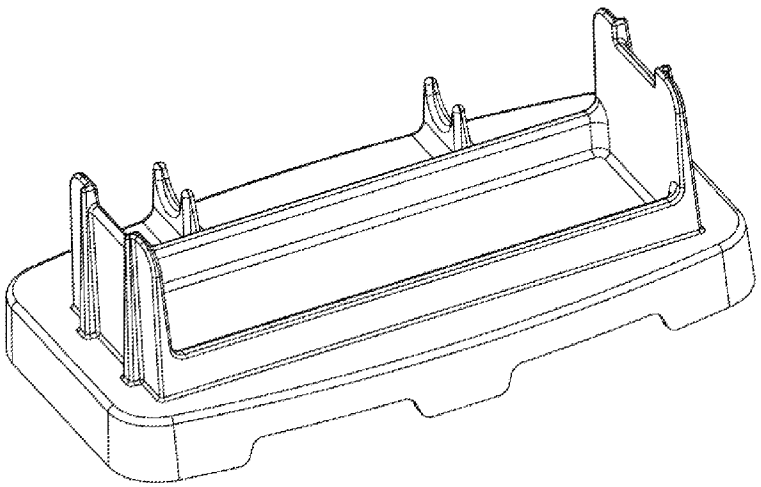
FIG. 3B is a perspective view of the same base.
Figure 3D:
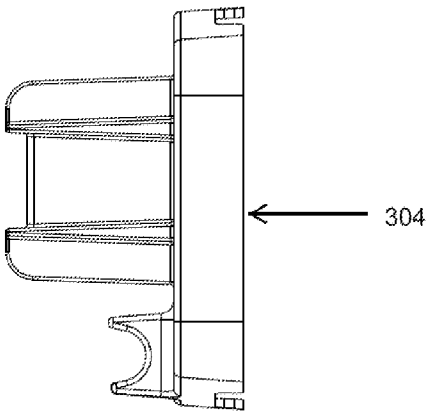
FIG. 3D is a rotated end view of the same base.
Figure 3A:
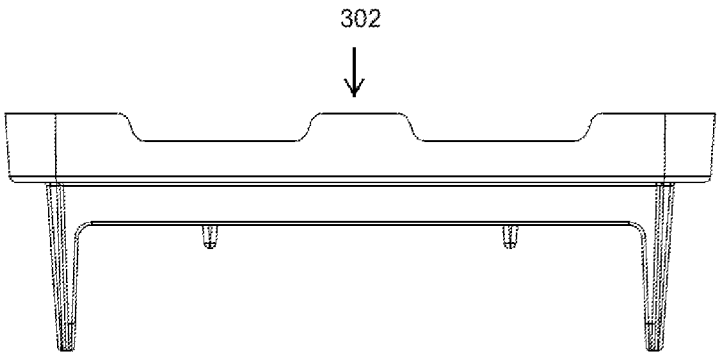
FIG. 3A is an inverted side view of the base of the butter dish of FIG. 1.
Figure 3C:
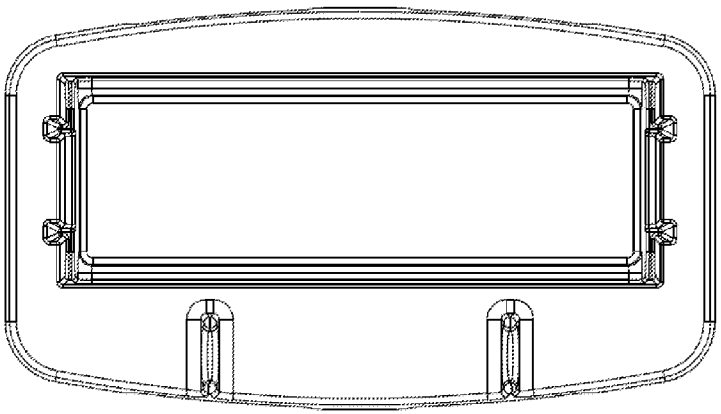
FIG. 3C is a plan view of the same base.

FIG. 3A shows an inverted side view of the base of FIG. 1. The bottom edge 302 is shown at the top. FIG. 3B shows a perspective view of the same base. FIG. 3C shows a plan view of the same base. FIG. 3D shows an end view of the same base rotated 90 degrees. The bottom edge 304 is shown on the side.

The base may be made of the same material or a different material than the cover. The colors may be selected for aesthetic considerations. Lighter colors or reflective surfaces may be used for the base and/or cover to reduce overheating of the butter when exposed to sunlight or infrared heat such as from a stove burner. Clips or other locking mechanism (not shown) may be provided to securely hold the cover on the base when transported, such as in a cooler to a picnic.

ALTERNATIVE EMBODIMENTS

Figure 4:
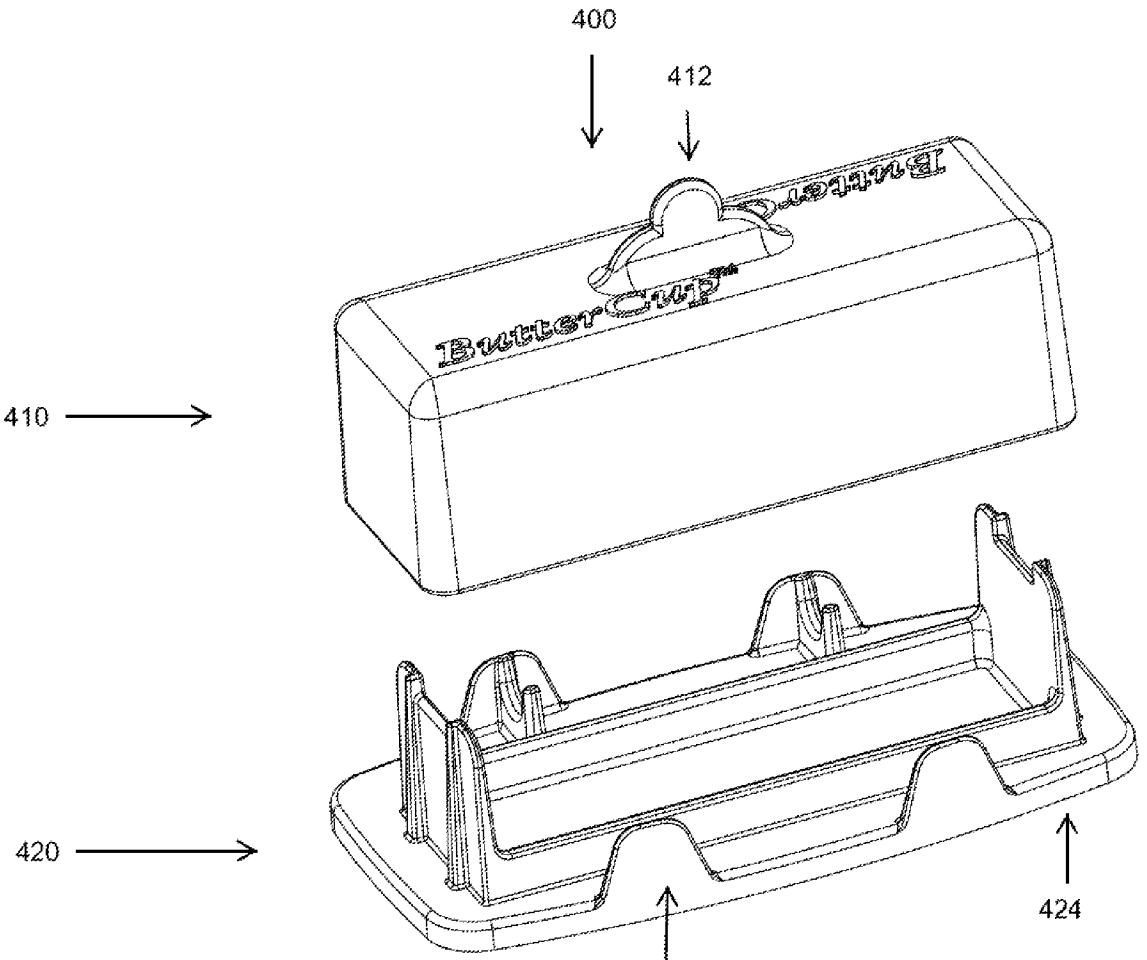
FIG. 4 is a perspective exploded view of an alternative embodiment of a room temperature butter dish.

FIG. 4 shows a perspective exploded view 400 of an alternative room temperature butter dish. The cover 410 comprises a handle 412. The bottom 424 of the base 420 is lower than the corresponding bottom of the base shown in FIG. 1. Vertical tabs 422 are provided for a person to grab and pick up the dish. The combined height and width of this design is less than that of the design in FIG. 1. This makes the dish easier to grab for persons with smaller hands.

Figure 5B:
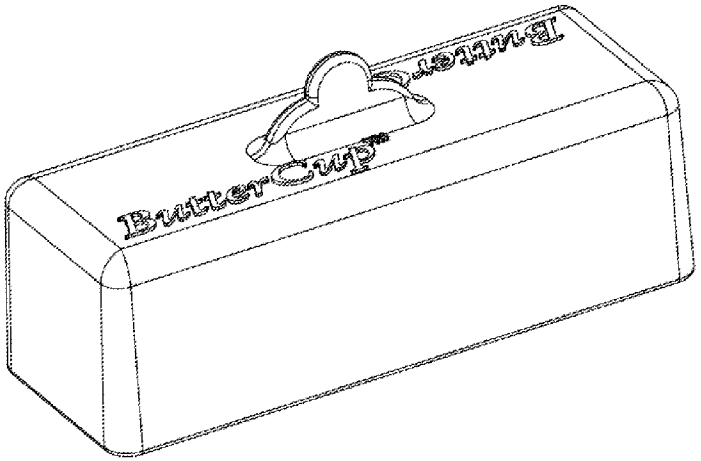
FIG. 5B is a perspective view of the same cover.
Figure 5D:
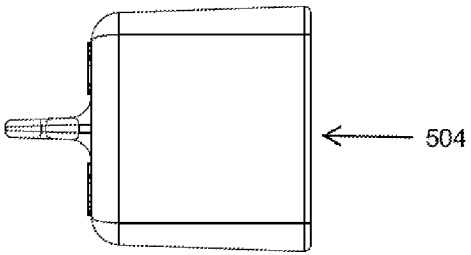
FIG. 5D is a rotated end view of the same cover.
Figure 5A:
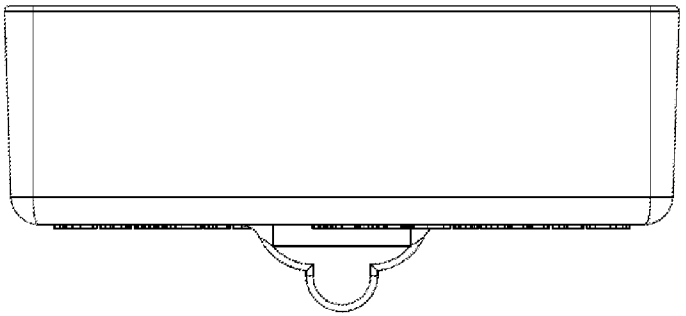
FIG. 5A is an inverted side view of the cover of the butter dish of FIG. 4.
Figure 5C:
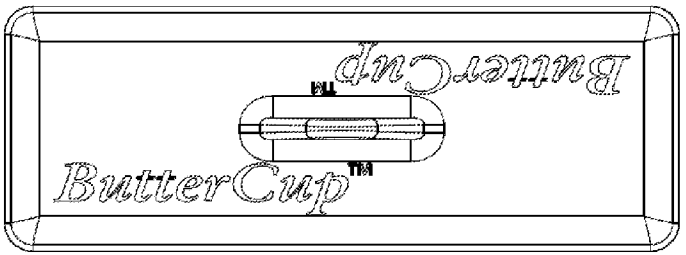
FIG. 5C is a plan view of the same cover.

FIG. 5A shows an inverted side view of the cover of FIG. 4. The bottom edge 502 is shown at the top. FIG. 5B shows a perspective view of the same cover. FIG. 5C shows a plan view of the same cover. FIG. 5D shows an end view of the same cover rotated 90 degrees. The bottom edge 504 is shown on the side.

Figure 6B:
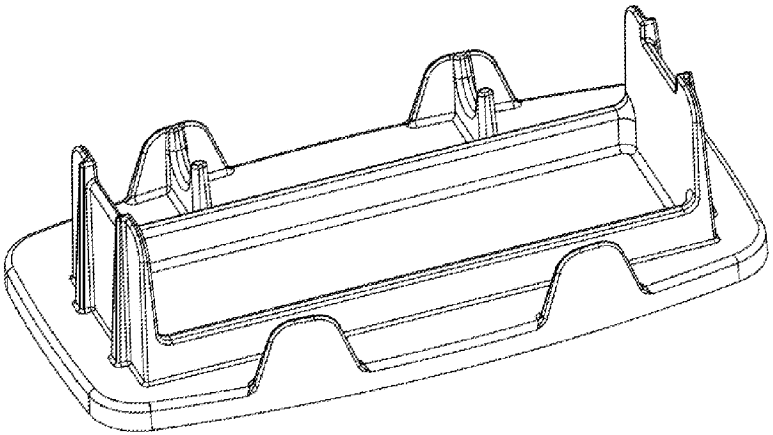
FIG. 6B is a perspective view of the same base.
Figure 6D:
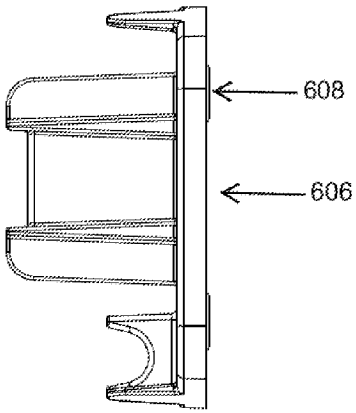
FIG. 6D is a rotated end view of the same base.
Figure 6A:
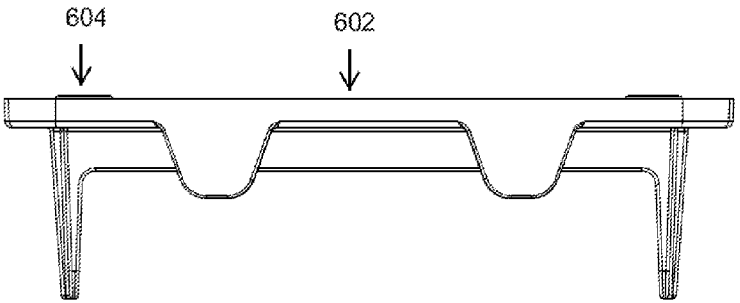
FIG. 6A is an inverted side view of the base of the butter dish of FIG. 4.
Figure 6C:
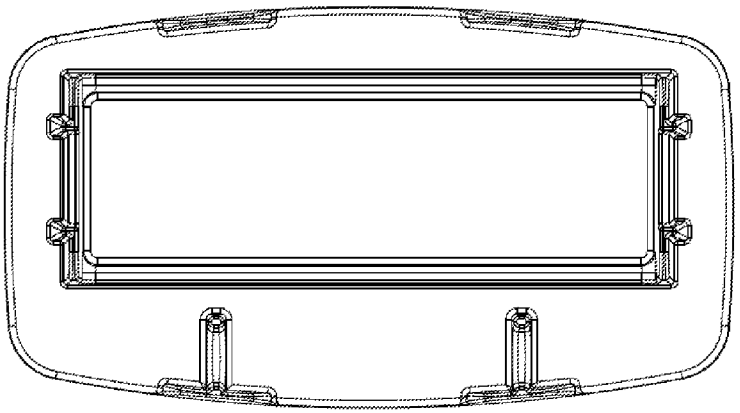
FIG. 6C is a plan view of the same base.

FIG. 6A shows an inverted side view of the base of FIG. 4. The bottom edge 602 is shown at the top. Small feet 604 are shown which raise the bottom edge slightly from the counter the dish sits on. This helps keep the dish clean since the bottom edges are not scraping on the counter. FIG. 6B shows a perspective view of the same base. FIG. 6C shows a plan view of the same base. FIG. 6D shows an end view of the same base rotated 90 degrees. The bottom edge 606 and feet 608 are shown on the side.

Figure 7:
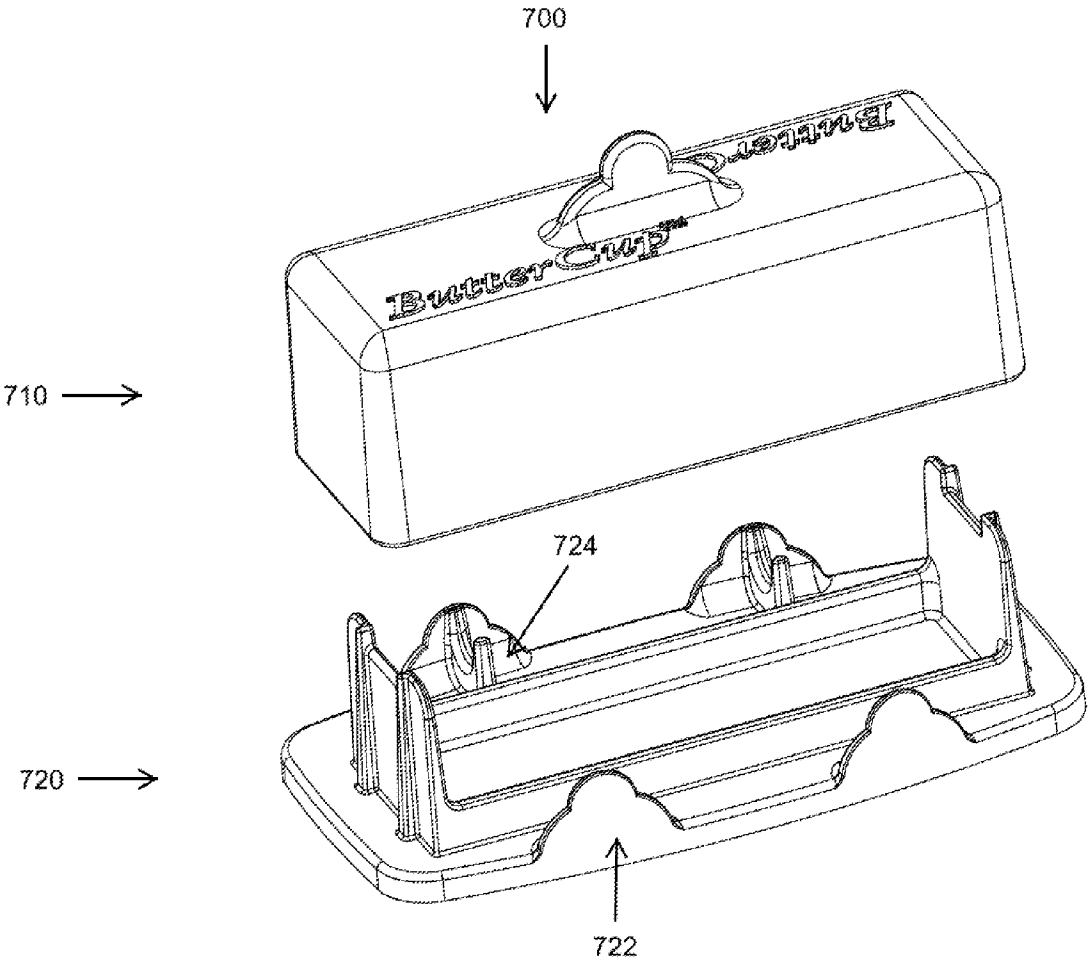
FIG. 7 is a perspective exploded view of an alternative embodiment of a room temperature butter dish.

FIG. 7 shows a perspective exploded view 700 of an alternative butter dish with a cover 710 and base 720. The design is similar to the butter dish of FIG. 4. The tabs 722 have a scalloped appearance. A large-radius reinforcement 724 is provided to support the tabs.

Example 1

Figure 8:
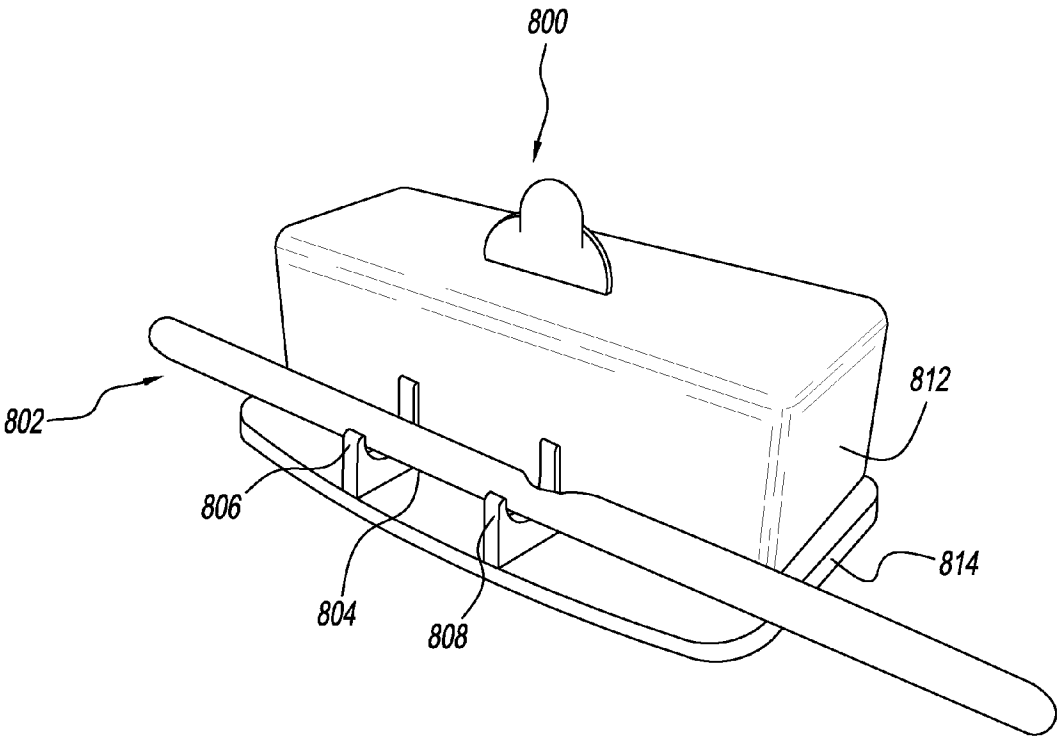
FIG. 8 is a perspective view of an alternative embodiment of a room temperature butter dish holding a butter knife.

FIG. 8 shows a perspective view of a room temperature butter dish 800 made according to the embodiment shown in FIG. 4, except there were no tabs 422 (FIG. 4). The butter dish was made by 3D printing of ABS. The printed cover 812 and base 814 were then treated with a solvent to give a smooth finish. A conventional Elgin stick of butter was placed in the dish and left out at room temperature. The butter was used for several days by members of a family. A butter knife 802 was provided with the dish. The butter knife was held in two U-channels 806, 808 such that the center of mass of the knife 804 was between the U-channels. Thus the knife was held in a stable horizontal position.

Figure 9:
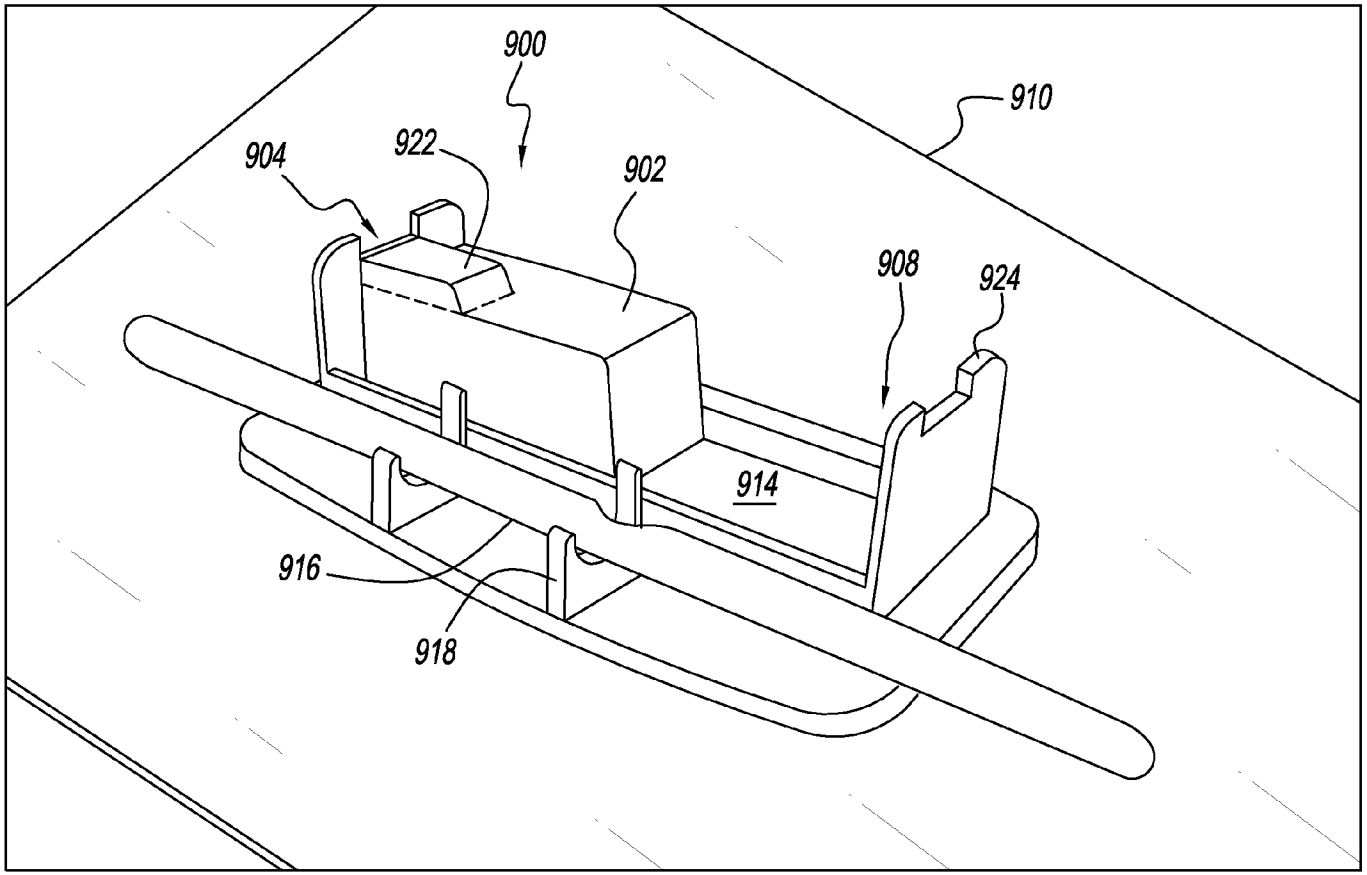
FIG. 9 is a perspective view of the butter dish of FIG. 8 with the cover removed showing butter after the dish has been used.

FIG. 9 shows the same butter dish with the cover removed. The base 900 rests on a counter 910. A partially consumed stick of butter 902 resides within the container volume 914. A butter knife 916 resides in a knife holder 918. The original dimensions of the stick of butter were about 1.3 inches by 1.3 inches by 5 inches. Excess butter 922 previously scraped off of the butter knife using the scraper 904 sits on top of the stick of butter but remains within the container volume. Excess butter on the other end of the base 908 sticks to the end wall or has fallen down to the bottom. All of said excess butter is available to be scraped out with the butter knife and used. Both the original stick of butter and the excess butter all remain within the container volume so they won't come in contact with the cover when the cover is placed on the base under the guidance of the end walls 924.

Figure 10:
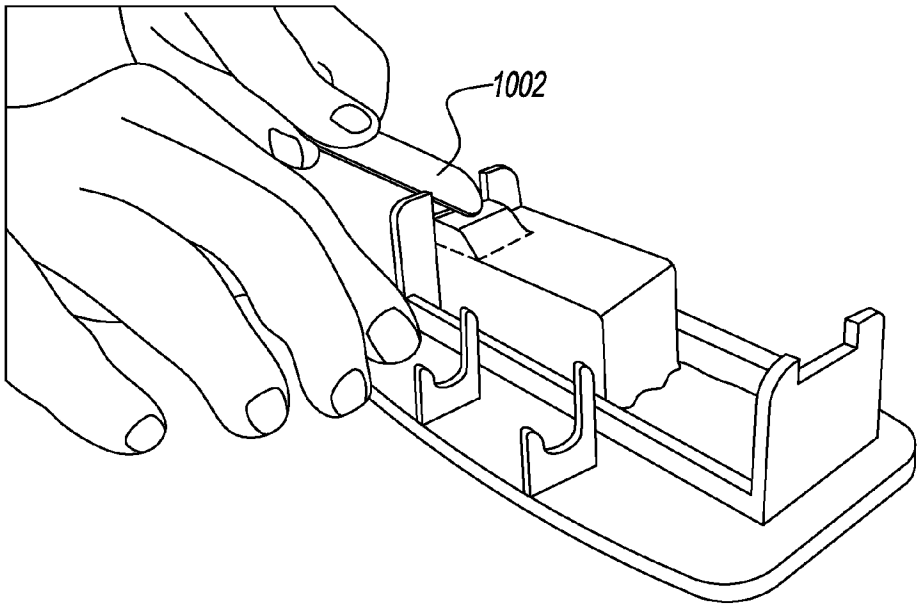
FIG. 10 is a perspective view of the same butter dish showing excess butter being scraped off of a butter knife by a user.

FIG. 10 shows the butter knife 1002 being drawn across the scraper by a user to remove excess butter on the knife.

Figure 11:
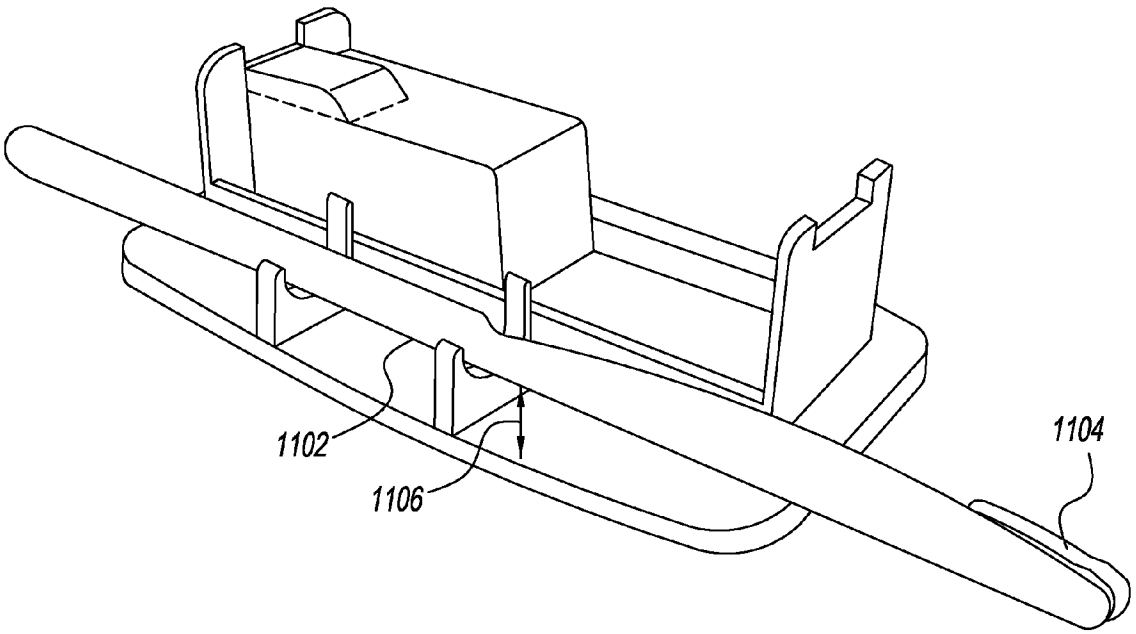
FIG. 11 is a perspective view of the same butter dish showing a butter knife with residual butter on the blade being held in the knife holder.

FIG. 11 shows a butter knife 1102 sitting in the knife holder with excess butter 1104 on its blade. The clearance 1106 provided by the knife holder is sufficient so that the excess butter on the blade does not come in contact with the counter.

Figure 12:
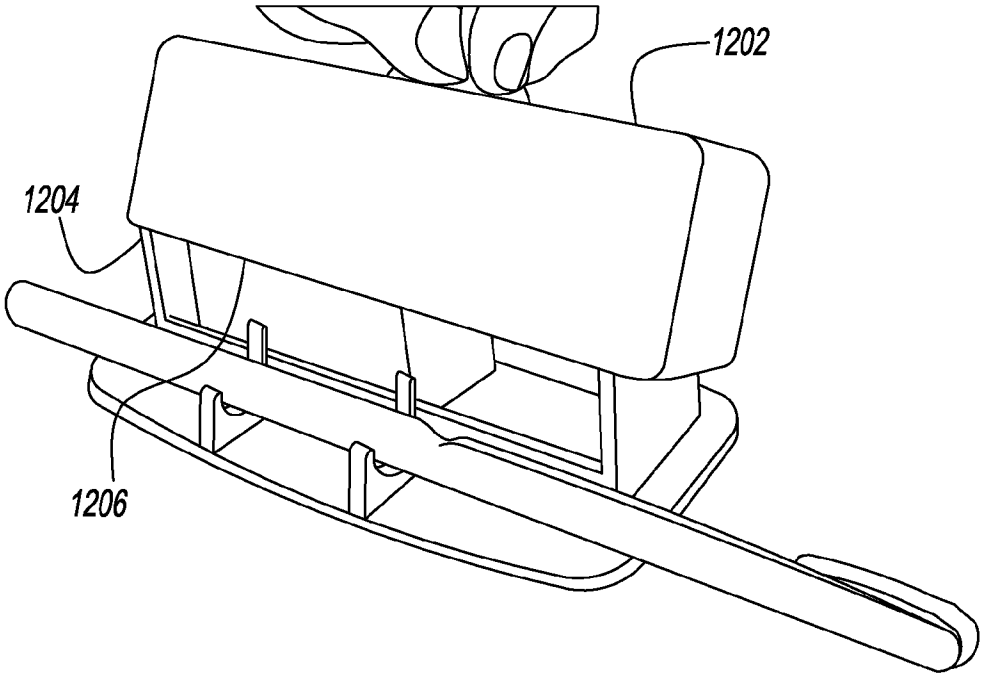
FIG. 12 is a perspective view of the same butter dish with the cover being lowered onto the base by a user.

FIG. 12 shows the cover 1202 as it is being placed on the base by a user. The shoulders 1204 on the end wall guide the cover so that the bottom edge of the cover 1206 stays out of the container volume. Hence the bottom edge stays free of butter despite the somewhat messy condition of the butter within the container volume.

CONCLUSION

This disclosure anticipates all obvious variations of the teachings presented herein. For example, the bottom of the base may be rounded to accommodate cylindrical sticks of butter such as those commonly sold in Europe. The bottom may be recessed into the base to give a lower overall height to the butter dish. The butter dish may have any surface features, indicia or colors consistent with its functionality.

We claim:

1. A butter dish, said butter dish comprising:

a) a cover; and b) a base, said base comprising:

i) a first end wall;

ii) a second end wall; and iii) a bottom wherein:

c) said first end wall and said second end wall are vertically attached to said bottom at opposite ends of said bottom and face each other such that the distance between said first end wall and said second end wall is greater than the length of a stick of butter;

d) said first end wall comprises:

i) a first shoulder;

ii) a second shoulder; and iii) a knife scraper;

e) said knife scraper forms a flat surface between said first shoulder and said second shoulder;

f) the height of said first shoulder is greater than the height of said scraper;

g) said base comprises a first side wall and a second side wall;

h) said first side wall and said second side wall are vertically attached to said base and said end walls;

i) the height of said first side wall is less than the height of said scraper; and j) the height of said second side wall is less than the height of said scraper.

2. The butter dish of claim 1 wherein the bottom of said first end wall is wider than the top of said first end wall.

3. The butter dish of claim 1 wherein said base further comprises a knife holder and wherein said knife holder comprises a first U-channel and a second U-channel.

4. The butter dish of claim 3 wherein said bottom comprises a first vertical tab on one side of said base and a second vertical tab on the opposite side of said base, said first and second tab being large enough and close enough together for a person to grab and lift said butter dish.

5. The butter dish of claim 4 wherein each of said tabs is located at about the midpoint of each of said sides of said base.

6. The butter dish of claim 1 wherein said first side wall comprises graduations.

7. The butter dish of claim 1 wherein said first end wall further comprises a vertical support and wherein said support is narrow at the top and wide at the bottom.

8. The butter dish of claim 1 wherein said bottom is rounded to accommodate a cylindrical stick of butter.

9. The butter dish of claim 1 wherein said bottom is recessed into said base.

10. The butter dish of claim 1 wherein said stick of butter is about 0.25 lb of butter.

11. The butter dish of claim 1 wherein said stick of butter is about 1 lb of butter.

12. The butter dish of claim 1 wherein the distance between said first side wall and said second sidewall is less than said distance between said first end wall and said second end wall.

* * * * *